US005855032A

United States Patent [19]

Field

[11] Patent Number: 5,855,032

[45] Date of Patent: Jan. 5, 1999

[54] QUILT

[76] Inventor: Kimberley D. Field, 122 Stagecoach Trail, Elizabeth, Colo. 80107

[21] Appl. No.: 963,231

[22] Filed: Nov. 3, 1997

[51] Int. Cl.[6] ..... A47G 9/02

[52] U.S. Cl. ..... 5/502; 5/949; 2/65; 2/69; 428/102

[58] Field of Search ..... 5/502, 482, 500, 5/949, 952; 2/69, 69.5, 65; 428/16, 102

[56] References Cited

U.S. PATENT DOCUMENTS

| | | | |
|---|---|---|---|
| 56,573 | 7/1866 | Klamke | 5/502 |
| 258,697 | 5/1882 | Bindseil | 2/65 |
| 2,348,807 | 5/1944 | Goodstein | 5/502 |
| 2,504,761 | 4/1950 | Turco | 5/949 |
| 4,809,375 | 3/1989 | Bull | 5/949 |
| 5,217,780 | 6/1993 | Wurzer | 5/949 |

*Primary Examiner*—Alex Grosz
*Attorney, Agent, or Firm*—Julie L. Bernard, P.C.

[57] ABSTRACT

An improved quilt comprising a first, second and third layer of material or fill providing a quilt having superior insulating capabilities and, thus, providing superior warmth to the user. These layers are comprised of at least one layer of fur or simulated fur disposed directly adjacent to a fill layer. Further, the quilt generally, but not necessarily, has a repeating pattern on the third layer of material disposed directly adjacent to the other side of said fill layer. The invention may be used, for example, as bedwear or throw as well as a lap robe.

2 Claims, 1 Drawing Sheet

QUILT

FIELD OF INVENTION

The present invention relates to the general field of bedding and/or bed wear, and more specifically, to quilts. This application, thus, describes a quilt possessing superior insulating capabilities and features for providing correspondingly superior warmth in conjunction with aesthetic appeal. Described is a quilt product in which one side thereof is composed of fur or synthetic fur, in which the other side thereof is composed of any knit, woven, nonwoven or other like fabric and disposed therebetween is a middle fill layer.

BACKGROUND AND PRIOR ART

A quilt is generally defined as a bed coverlet of two layers of cloth, filled with padding, such as down or batting, held in place by ties or stitched designs. Comforters, bedspreads, quilts and like bedwear have long been used, in addition to normal sleeping usage, to protect other bedding from soil as well as serve a decorative purpose. However, to achieve superior warmth, the consumer has had to forfeit aesthetics and, thus, these items are then not the centerpiece of bedroom decor. Heretofore, no bedwear has served the dual purpose of providing superior warmth via insulating features, while being aesthetically pleasing and serving a primary decorative purpose as well.

In attempts to solve this limitation, prior art quilts and other bedding, including for example, bed spreads and comforters, have been proposed which are either insulating or decorative. These aspects allow the user to achieve only one of their goals, but however do not provide a decorative and superiorly warm bed covering, a quilt.

The prior art discloses several different types of bed coverings. U.S. Pat. No. 3,565,025, to Owen, describes a single article of bedwear to serve the dual purpose and function of both a bed spread and a blanket.

U.S. Pat. No. 2,271,281, to Whitman, discloses a novel type of bedding that employs air pockets for warmth. Said bedding may provide superior warmth in comparison to average bedding, however, it does not employ fur or simulated fur to provide such warmth, nor is it intended for use other than bedding.

Danova, U.S. Pat. No. 5,084,930, describes a soft sculpture creature useful as a blanket. Said creature is intended as a novelty bedding item, not as a superior warmth providing piece of bedding.

An improved bedspread having a number of reversible and interchangeable panels is disclosed in U.S. Pat. No. 5,251,350, to Bordenave, Sr. et al. Said bedspread is useful for aesthetic purposes—to change the look of a room. It is not a superior warmth providing quilt that is also aesthetically pleasing.

U.S. Pat. No. 56,573 to Klamke, discloses an improvement in robes having both fur and cloth and useful in a way similar to a blanket, throw or wrap. However, these robes may serve to vary the utility of a bed covering, but do little, if anything, to vary the aesthetic appeal of a bed covering.

Shortcomings found in the prior art include, for example, lack of aesthetic appeal, lack of warmth, limited usefulness and various combinations of the above. In fact, aesthetic appeal and superior insulating qualities appear to be almost mutually exclusive in the art. The present invention overcomes these drawbacks by integral incorporation of insulating and decorative surface characteristics and features into the same quilt. The construction of the instant invention is highly suitable for the above-stated purposes as it is made from, for example, at least one layer of fur or simulated fur, one layer of fill such as batting and a third layer of fabric, said layers tied or stitched in a quilting fashion. While prior art is suitable for general bed covering purposes or decorative purposes, none of the prior art easily and efficiently uses insulating features to provide superior warmth to the user while providing superior aesthetic appeal. The present invention provides a novel quilt composition, made from a plurality of layers, including at least one of fur or simulated fur—an ideal material of construction for the present invention.

Fur and simulated fur are naturally insulating based on their loft, or the amount of air able to be trapped between the lengths each hair. When combined with conventional fill, such as batting, and a third layer of fabric, the combination provides superior warmth and aesthetic appeal.

According to this invention, this combination provides a decorative outer fabric surface on one side thereof to be utilized as the upper surface when positioned on a bed thus providing aesthetic appeal, and a fur or synthetic fur outer surface on the other side thereof to be utilized as the under insulating surface when positioned on a bed. This positioning description is not intended to be limiting in that the improved quilt described herein is completely reversible based on the user's desires. By this construction, the use of the combination of numerous sheets, blankets and comforters in the cold winter months is obviated. Furthermore, there is provided a quilt in which the upper side thereof is possessed of a decorative woven, nonwoven or knit fabric which is desirable for the exposed surface of a bed covering and in which the underside is possessed of a fur or synthetic fur surface for superior warmth.

While prior art bedwear may allow a person to keep warm or decorate a room, it does not take the form of an object who's specific purpose is to both insulate the user while serving a primary decorative purpose. In addition, the prior art does not disclose the use of fur loft to enhance the air capture features and, therefore, increase insulating properties in bedwear. Current commercially available quilts are quite pleasing to the eye and frequently used in decorative ways. However, they are generally also used with a number of conventional blankets underneath in order to provide adequate warmth. The instant invention provides a quilt that is useful in two equally important aspects, warmth and aesthetics.

SUMMARY OF THE INVENTION

This invention is based on a novel concept for an improved quilt. The present invention is defined by a multilayered quilt having at least one layer of fur or synthetic fur; said quilt capable of being used as a bed covering or lap robe, and all derivatives thereof. The present invention, when practiced as disclosed herein, provides an aesthetically pleasing quilt of superior warmth. The instant invention, thus, is useful as disclosed above, but is not intended to be limited to these uses.

In its broadest terms, the quilt disclosed herein is comprised of at least one fur or synthetic fur surface; said quilt being constructed in any number of sizes, for example, sizes corresponding to conventional mattress sizes. Accordingly, it is an object of the invention to provide a quilt for supplying superior warmth to the user and that is also aesthetically pleasing and may be used as a bed cover, wrap, throw or the like.

All embodiments of the instant invention include the same general elements; a quilt having a plurality of layers, at least one layer comprising fur or synthetic fur, at least one layer comprising woven, nonwoven or knit fabric and at least one layer of fill disposed therebetween.

Other features and advantages of the present invention will become apparent from the following detailed description, taken in conjunction with the accompanying figures, that illustrate by way of example, the principles of the instant invention.

DETAILED DESCRIPTION OF THE PREFERRED EMBODIMENT

It is to be understood that both the foregoing general description and the following detailed description are exemplary and explanatory only and are not restrictive of the invention as claimed. The present invention provides a quilt of novel tripartite layer construction giving rise to extraordinary warmth as well as being particularly aesthetically pleasing. It is recognized by those skilled in the art that the practice of a broad range of quilts or the like may be performed in accordance with the present invention.

The term "quilt" as used herein, generically includes any covering of the quilt type. That is, one that most people would specifically call by the name quilt, or by any at least partly analogous term such as blanket, comforter, coverlet, lap robe, afghan, bedsheet, bedspread, futon, duvet, sleeping bag, or the like. Certainly, one skilled in the art is aware that the instant invention is also applicable to conventional pillow covers and mattress covers. The quilt disclosed herein is generally rectangular, with an upper outer surface, a lower outer surface, and a perimeter comprised of edges. However, the actual shape of the invention is not necessarily rectangular in that it may be customized to possess any general shape—the general rectangular shape disclosed herein is useful for illustrative purposes only. The above terms are used in their usual sense, from the perspective of a person using or viewing the quilt. No specific limitations, not apparently essential, are thereby intended.

Figure 1:
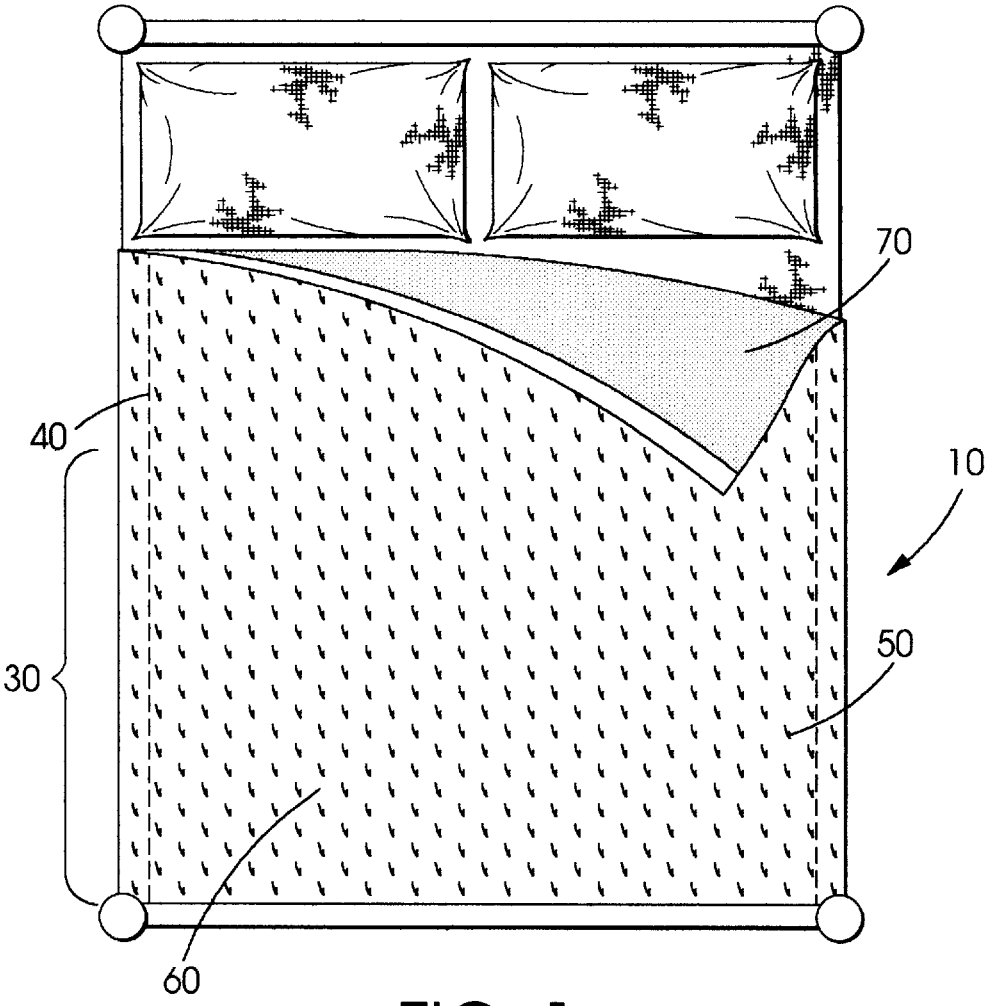
FIG. 1 is a perspective view of a bed illustrating the use of the quilt product of this invention thereon.

The details of the basic structure of the preferred embodiment of the invention are illustrated in FIG. 1. Depicted is a tripartite layer combination of a fur or synthetic fur outer surface on one side and either a knit, woven, nonwoven or otherwise like fabric outer surface on the other side. Interposed between the two sides is a layer of fill, for example batting, that is suitably secured through either tying or stitching it in place in a conventional quilting fashion. Means such as stitches are preferably employed to bind the perimeter edge of said layers together and means such as stitches or ties at intervals throughout the layers are also provided, forming a multiplicity of air insulating cells, pockets or spaces between said layers and an aesthetically pleasing pattern. Said quilt is ornamented or trimmed in any customized fashion to suit the fancy of the maker or user.

The preferred sizes, as disclosed above, correspond to all conventional mattress sizes, including for example, king, queen, double, single and crib. However, size as well as shape may be changed and/or scaled up or down, accordingly.

Figure 2:
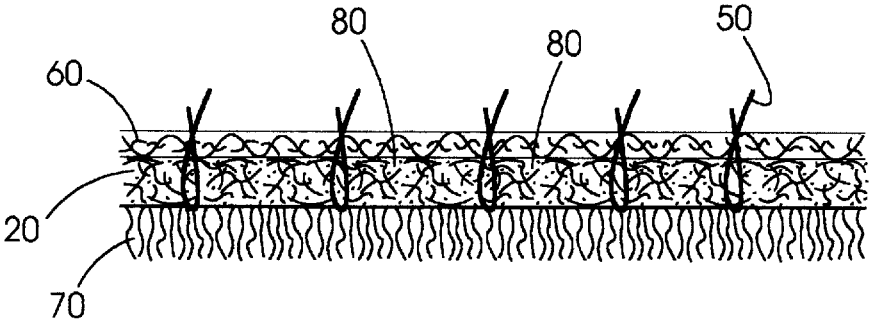
FIG. 2 is a sectional view of the tripartite nature of the instant invention.

Referring now to the drawings, there is illustrated in FIGS. 1 and 2, the quilt of this invention, generally indicated by the reference numeral 10 shown in place on a bed. This quilt 10 comprises a three-dimensional fill 20 of woven or nonwoven fibers that are held together, in place or reinforced by conventional quilt stitching 40 or conventional quilt ties 50 throughout the dimensions thereof. The quilt 10 further comprises a decorative knit, woven, non-woven or the like fabric surface 60 on one side thereof to be utilized as the upper surface when positioned on a bed and a fur or simulated fur surface 70 on the other side thereof to be utilized as the under surface when positioned on a bed.

As is seen more specifically in FIG. 2, this quilt 10 comprises a plurality of layers. Said layers are held together and reinforced by conventional stitches 40 and/or ties 50 throughout the dimensions thereof. The fill layer 20, or batting, is bonded or held in place by a plurality of stitches 40 or ties 50 penetrating therethrough and arranged, for example, in closely spaced-apart, parallel, exposed rows of stitches or ties on the fabric side 60 of the quilt which extend in generally the lengthwise direction thereof, thus providing strength and stability thereto. The fill or batting 20 may be any suitable natural or synthetic fibers, for example, viscose or acrylic or other textile fibers or blends thereof with wool, nylon, polypropylene, down, kapok and polyester; any flocculent material interposed between the respective outer layers 60, 70 of said quilt is suitable.

Moreover, means such as stitches 40 are preferably employed to bind the perimeter edges 30 of said fabric 60 and fur or synthetic fur 70 layers together and means such as ties 50 therethrough at intervals throughout the dimensions of said quilt 10 may also be provided, thereby forming a multiplicity of internal, insulating air cells 80 spaced between the fabric 60 and fur or synthetic fur 70 layers trapping air within the interposed fill layer 20.

Thus, it may be seen that by this invention, there is provides a quilt product that is specifically characterized by providing a fur or synthetic fur surface on one side thereof and a woven, nonwoven or knit fabric on the other side thereof. While specific embodiments of the invention have been illustrated and described herein, these should not be construed as limitations on the scope of the invention, but rather an exemplification of the preferred embodiments thereof. Numerous variations are possible and will occur to those skilled in the art. It is therefore to be understood that the appended claims are intended to cover all such modifications and changes as fall within the true spirit and scope of the invention.

I claim:

1. An improved quilt comprising: a fur or synthetic fur lower layer having insulating properties; a fabric upper layer having aesthetic appeal; disposed therebetween a layer of fill; a first means binding the edge of said upper and lower layers together to firm a quilt; and second means binding said upper and lower layers together at intervals throughout the dimensions of said quilt, whereby said second binding means forms a multiplicity of insulating air cells between said upper and lower layers.

2. A quilt specifically characterized by providing a fabric surface on one side thereof to be utilized as the upper surface when placed in position on a bed to provide aesthetically pleasing characteristics and appearances; providing a fur or synthetic fur surface in which no stitching is exposed on the other side thereof to be utilized as the under surface when place in position on a bed to provide warmth and insulating characteristics; and providing a fill layer interposed between said surfaces having a plurality of stitches penetrating therethrough creating insulating air cells.

* * * * *